US005682610A

United States Patent [19]

Warner

[11] Patent Number: 5,682,610

[45] Date of Patent: Nov. 4, 1997

[54] TWO-HANDED RECEPTACLE

[76] Inventor: Martha J. Warner, 45 Dry Bridge Rd., Canton, Conn. 06019

[21] Appl. No.: 668,218

[22] Filed: Jun. 21, 1996

[51] Int. Cl.[6] ..... A41D 19/00

[52] U.S. Cl. ..... 2/158; 2/159

[58] Field of Search ..... 2/158, 159, 160, 2/208

[56] References Cited

U.S. PATENT DOCUMENTS

| | | | |
|---|---|---|---|
| D. 192,992 | 6/1962 | Ruiter . | |
| D. 202,409 | 9/1965 | Harlamert . | |
| 480,852 | 8/1892 | Kahn . | |
| 1,310,120 | 7/1919 | Kreamer . | |
| 1,849,418 | 3/1932 | Chesebro . | |
| 2,315,889 | 4/1943 | Wells . | |
| 2,611,901 | 9/1952 | Neider . | |
| 3,203,005 | 8/1965 | Burrows | 2/158 |
| 3,491,373 | 1/1970 | Thomas . | |
| 4,085,464 | 4/1978 | Simonoff | 2/158 |
| 4,564,956 | 1/1986 | DiBuono | 2/158 X |
| 5,345,610 | 9/1994 | Belanger . | |
| 5,542,125 | 8/1996 | Zuckerwolr | 2/158 |

*Primary Examiner*—C. D. Crowder
*Assistant Examiner*—Shirra L. Jenkins
*Attorney, Agent, or Firm*—Kenneth F. Dusyn

[57] ABSTRACT

A two-handed glove receptacle for enclosing the left hand of one person and the right hand of another to permit contact of the hands within a common compartment. The receptacle preferably takes the form of a pair of mittens joined together at an opening provided in the palm side of the palm-and-fingers section of each mitten, the opening defining an area generally covering the palm and fingers of the hand, excluding the thumb. Separate thumb compartments are provided which provide for an ergonomical fit for the persons sharing their left and right hands within the receptacle to obtain protection from the natural elements. A pair of mittens capable of being converted to a receptacle for receiving the left hand of a first person and the right hand of a second person is also provided in which each mitten additionally includes a removable flap for covering the opening provided in the palm side of the palm-and-fingers section of each mitten when the mittens are not joined to each other, and means for removably joining the left- and right-handed mittens about the perimeter of the respective openings when the openings are uncovered by the respective flaps.

39 Claims, 6 Drawing Sheets

TWO-HANDED RECEPTACLE

BACKGROUND OF THE INVENTION

1. Field of the Invention

The present invention relates to a protective cover for the hands, and more particularly, to a two-handed receptacle for enclosing the left hand of one person and the right hand of another to permit contact of the hands within a common compartment. The receptacle preferably takes the form of a pair of mittens rendered capable of being joined together in an ergonomical manner to allow contact of a couple's hands for protection from the natural elements.

2. Related Art

Various forms and designs of muffs, gloves, mitten and mitten combinations are known for protecting the shared hands of more than one person from the natural elements in a cold climate. For example, U.S. Pat. No. 5,345,610 issued Sep. 13, 1994, discloses a mitten set that includes inter alia a glove with a glove member finger, and a second-entrance opening to receive the entire hand of a child for sharing the glove body 20 by an associated adult and child (FIG. 3). No provision is made for the thumb of the child which, along with the remainder of the child's hand, is inserted into the singular glove member. Unfortunately, the containment of the entire hand of the child within the single glove member allows for the glove's shifting and unravelment leading to an uncomfortable fit when the child's hand is disassociated from the hand of the adult. Ergonomically, this presents an undesirable set of conditions.

Another example is disclosed in U.S. Pat. No. 3,491,373 issued Jan. 27, 1970, in which a muff-type hollow receptacle is provided with a pair of openings and corresponding sleeves less than 180° apart for receiving and retaining two hands, one each of two different persons. The entire hand of each of the two individuals are contained within the receptacle, and once inside, it is difficult to control any shifting of the receptacle about the wrists, a condition that is uncomfortable for the two persons sharing the muff. An ergonomical fit is not provided for. Similar examples are illustrated in FIGS. 5, 7 and 8 of U.S. Pat. No. 2,611,901 issued Jan. 13, 1950, and in U.S. Pat. No. Des. 192,992 issued Jun. 12, 1962, and U.S. Pat. No. Des. 202,409 issued Sep. 28, 1965.

Variations to a basic mitten have also been disclosed in U.S. Pat. No. 1,310,120 issued Dec. 19, 1917; U.S. Pat. No. 1,849,418 issued Nov. 29, 1930; and U.S. Pat. No. 2,315,889 issued Jul. 28, 1942, wherein the theme of using a flap to expose the four fingers extending from the palm of the hand are described, none of which are adequate for or suggest the possibility of joining two mittens to each other.

For the purposes of the invention herein, a mitten is defined as an enclosure for the hand and wrist, and is comprised of a wrist and hand compartment. The wrist compartment envelops the general area of the wrist and extends forwardly from the entrance to the mitten to approximately the upper end of the hand compartment for receiving the hand therethrough. The hand compartment is made up of two sections: a palm-and-fingers section which envelops both the back and front of the palm and fingers of the hand, excluding the thumb, with both the back and front sides of the hand compartment running the full width of the hand, i.e., the palm and fingers; and a thumb section which includes a small opening provided about one lateral side of the palm side of the palm-and-fingers section, proximate to the upper end of the hand compartment, to which is attached a thumb contoured enclosure for the insertion and envelopment of the thumb. The lateral orientation of the thumb section relative to the palm side of the palm-and-fingers section characterizes the mitten as a left- or right-handed mitten.

SUMMARY OF THE INVENTION

In accordance with the present invention, a receptacle is provided for receiving the left hand of a first person and the right hand of a second person, such that contact of the respective left and right hands, exclusive of the thumbs, is possible within the interior of the receptacle. The receptacle comprises a left wrist and hand compartment connected to each other for enclosing the left wrist and hand, respectively, and a right wrist and hand compartment connected to each other for enclosing the right wrist and hand, respectively. Each of the hand compartments comprises (i) a palm-and-fingers section for enclosing the fingers and back and front side of the palm, excluding the thumb; and (ii) a thumb section connected to the palm-and-fingers section for enclosing the thumb.

The receptacle also comprises means for joining the left- and right-hand compartments about a perimeter of an opening provided in the palm side of the palm-and-fingers section of each hand compartment. The perimeter defines an area generally covering the palm and fingers of the hand, excluding the thumb. When the left- and right-hand compartments are joined together, a common compartment is formed that permits contact of the left hand of the first person and the right hand of the second person, exclusive of their thumbs, interiorly thereof.

Optimally, the receptacle includes a left- and right-handed mitten each comprising a wrist, thumb and hand compartment for enclosing the wrist and hand; and means for joining the mittens about the perimeter of an opening provided in the palm side of the hand compartment of each mitten. As indicated above, the perimeter defines an area generally covering the palm and fingers of the hand, excluding the thumb, to permit contact of the left hand of the first person and the right hand of the second person within the joined mittens.

The longitudinal axis of the respective wrist compartments connected to the joined left- and right-hand compartments of the receptacle, or mittens making up the receptacle, form an angle less than 120 degrees with respect to each other, preferably an angle in the range of from about 15 to about 120 degrees, and optimally from about 45 to about 100 degrees. The left and right hand compartments may be fixedly secured to each other by any conventional means known in the art, such as, but not limited to, by sewing or stitching. Detachable means that are conventional in the art may also be utilized and include, but are not limited to, a hook and loop fastener, e.g., that which is available and sold under the trademark VELCRO®, button means, a plurality of snaps, a zipper, and the like.

In accordance with another aspect of the invention, the foregoing receptacle for receiving the left hand of a first person and the right hand of a second person, which is preferably in the form of a pair of mittens, i.e., a left- and right-handed mitten, may additionally comprise a means for covering the opening provided in the palm side of the palm-and-fingers section of each hand compartment, preferably a removable flap, and means for removably joining the left and right hand compartments about the perimeter of the respective openings when the openings are uncovered by the respective flaps. The removable flaps are useful in that (i)

they can cover the openings when the left and right hand compartments are not joined to each other, thereby introducing a convertibility factor for allowing the left and right wrist and hand compartments to be used for the respective left and right hands of the same person; and (ii) they can be partially or wholly removed to permit joinder of the left and right hand compartments about the opening provided in the respective palm-and-fingers section as described above.

In one embodiment of the invention, the rearward end of the flap, relative to the wrist compartment, is fixed at approximately the rearward portion of the palm-and-fingers section and the forward portion of the flap is folded back and detachably secured to the wrist compartment when the right and left hand compartments are joined together. Alternatively, instead of folding back and attaching the flap to its respective wrist compartment, the flap can be folded rearwardly and inserted within the confines of its respective wrist compartment.

In yet another embodiment, the flap of each hand compartment may be positioned over the back side of the opposite palm-and-fingers section when the right and left hand compartments are joined together. The forward portion of each flap can be detachably secured to either (i) the back side of the opposite palm-and-fingers section or (ii) the forward portion of the palm-and-fingers section of the respective hand compartment. Another embodiment has the forward end of the flap, relative to the wrist compartment, fixed with the forward portion of the palm side of its respective palm-and-fingers section. The flap is positioned over the back side of the opposite palm-and-fingers section when the right and left hand compartments are joined together, and the rearward portion of each flap can then be detachably secured to either (i) the back side of the opposite palm-and-fingers section or (ii) the rearward portion of the palm-and-fingers section of the respective hand compartment. When the flap is positioned or folded over the back side of the palm-and-fingers section of the opposite hand compartment and detachably secured, an added degree of securement of the left and right hand compartments to each other is assured.

In another embodiment, when the forward end of the flap, relative to the wrist compartment, is fixed with the forward portion of the palm side of the palm-and-fingers section, the rearward portion of each flap may be detachably secured to the back side of the palm-and-fingers section of the respective hand compartment when the right and left hand compartments are joined together.

Any conventional means known in the art for detachably securing the flaps may be used, and include, but are not limited to, a hook and loop fastener, at least one button means, or at least one snap means.

For ease of manufacture, the flap and receptacle are preferably constructed of the same material although different materials can be used for aesthetic purposes.

In yet another aspect of the invention, the invention includes a pair of mittens capable of being converted to a receptacle for receiving the left hand of a first person and the right hand of a second person. The pair of mittens comprises a left- and right-handed mitten, each comprising a wrist and hand compartment connected to each other for enclosing the wrist and hand. Each hand compartment comprises (i) a palm-and-fingers section for enclosing the fingers and back and front side of the palm, excluding the thumb; (ii) a thumb section connected to the palm-and-fingers section for enclosing the thumb; and (iii) a removable flap for covering an opening provided in the palm side of the palm-and-fingers section of each mitten when the palm-and-fingers section are not joined to each other. The opening has a perimeter defining an area generally covering the palm and fingers of the hand, excluding the thumb. The pair of mittens additionally comprises means for removably joining the left- and right-handed mittens about the perimeter of the respective openings when the openings are uncovered by the respective flaps.

In one embodiment, the flap of each mitten may be removed when it is desired to join the mittens together. However, as a preference, the rearward end of each flap, relative to the wrist compartment, is fixed at approximately the rearward portion of the palm side of the palm-and-fingers section, the flap being configured to fold rearwardly to permit exposure of the opening in the palm-and-fingers section. The rearward end of the flap is preferably integral with the palm-and-fingers section of the mitten. The flap may be folded rearwardly through the opening for insertion within the confines of the wrist compartment, or alternatively, each mitten may additionally comprise means for detachably securing the forward portion of the flap (i) to its respective wrist compartment, (ii) to the forward portion of its respective palm-and-fingers section, or (iii) to the back side of the opposite palm-and-fingers section.

In another embodiment, the forward end of the flap, relative to the wrist compartment, may be fixed with the forward portion of the palm side of the palm-and-fingers section, the flap being configured to fold forwardly to permit exposure of the opening in the palm-and-fingers section. The forward end of the flap is preferably integral with the palm-and-fingers section of the mitten. The mittens may additionally comprise means for detachably securing each respective flap to (i) the back side of its respective palm-and-fingers section, (ii) the rearward portion of its respective palm-and-fingers section, or (iii) the back side of the opposite palm-and-fingers section.

With regard to the means for detachably securing the flap to its respective wrist compartment, the back side of the palm-and-fingers section of the opposite hand compartment, or the forward or rearward portion of the respective hand compartment, such means may include, but are not limited to, a hook and loop fastener, at least one button means, or at least one snap means. The flap and mitten are preferably constructed of the same material.

BRIEF DESCRIPTION OF THE DRAWINGS

A complete understanding of the present invention may be obtained by reference to the following specification when taken in conjunction with the accompanying drawings wherein certain preferred embodiments are illustrated and wherein like numerals refer to like parts throughout. Thus.

DETAILED DESCRIPTION OF THE INVENTION AND PREFERRED EMBODIMENTS THEREOF

The present invention provides an improved protective wearing apparel for the hands, and more specifically, provides a two-handed receptacle for receiving the left hand of a first person and the right hand of a second person for the purpose of protecting the hands from the elements while at the same time permitting the hands to have contact and be joined within the same receptacle. The receptacle according to the invention offers an ergonomical arrangement for two people desiring to have hand-to-hand engagement with one another within a common receptacle, and is unique in that separate compartments are provided for the wrists and thumbs of the two individuals while sharing a common compartment for the remainder of the hands. The advantage is that the receptacle is prevented from shifting about the wrist of the respective individuals while their hands are joined therein, a situation that would present itself if the entire hand of each individual, inclusive of the thumb, were inserted into the receptacle. Moreover, by providing for separate thumb compartments, an ergonomical fit for the different hands is provided, especially when the two individuals are walking or sitting side by side.

The receptacle advantageously takes the form of a pair of mittens that are joined together about an opening provided in the palm-and-fingers section of the hand compartment of each mitten. The palm-and-fingers section envelop the hand with the exception of the thumb, and by joining the mittens at an angle of approximately less than 120°, preferably between about 15° and 120°, and optimally from about 45° to about 100°, as measured by the angle between the longitudinal axis of the right wrist compartment and the longitudinal axis of the left wrist compartment, a comfortable insertion of the left and right hand of two different persons into the joined mittens is accomplished. Moreover, by joining the mittens in the manner described herein, the left and right hand of the two individuals fall naturally into place, thereby providing an ergonomical fit for the hands and a comfortable position for engaging the hands while the two individuals are, for example, walking or sitting side by side. Additionally, the receptacle formed by the joined mittens offers protection from exposure to a cold climate, and also provides a common compartment for the generation of body heat by the contact of the shared hands.

Figure 2:
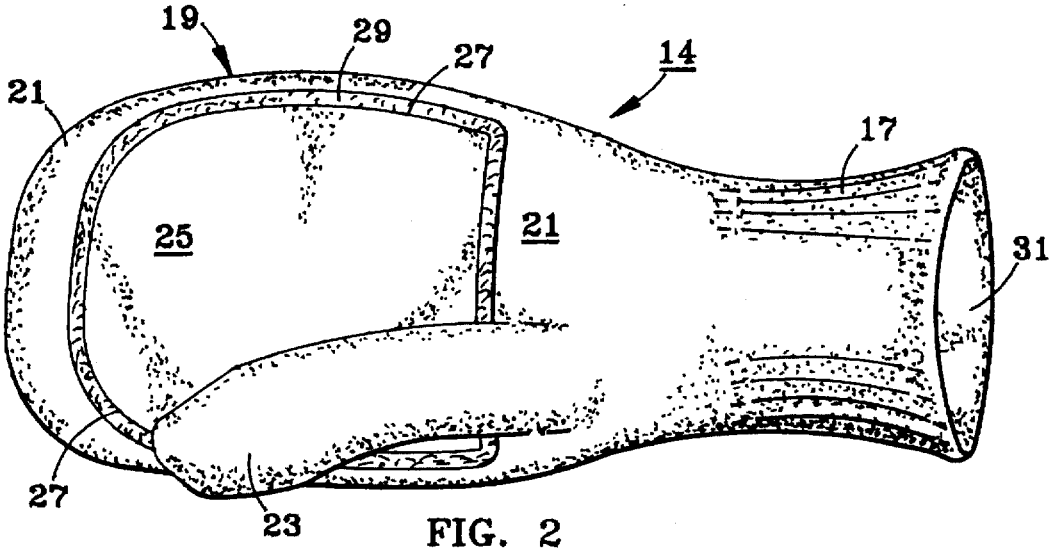
FIG. 2 is a top plan view of a left-handed mitten having an opening in the palm side of the palm-and-fingers section in accordance with the invention herein.
Figure 3:
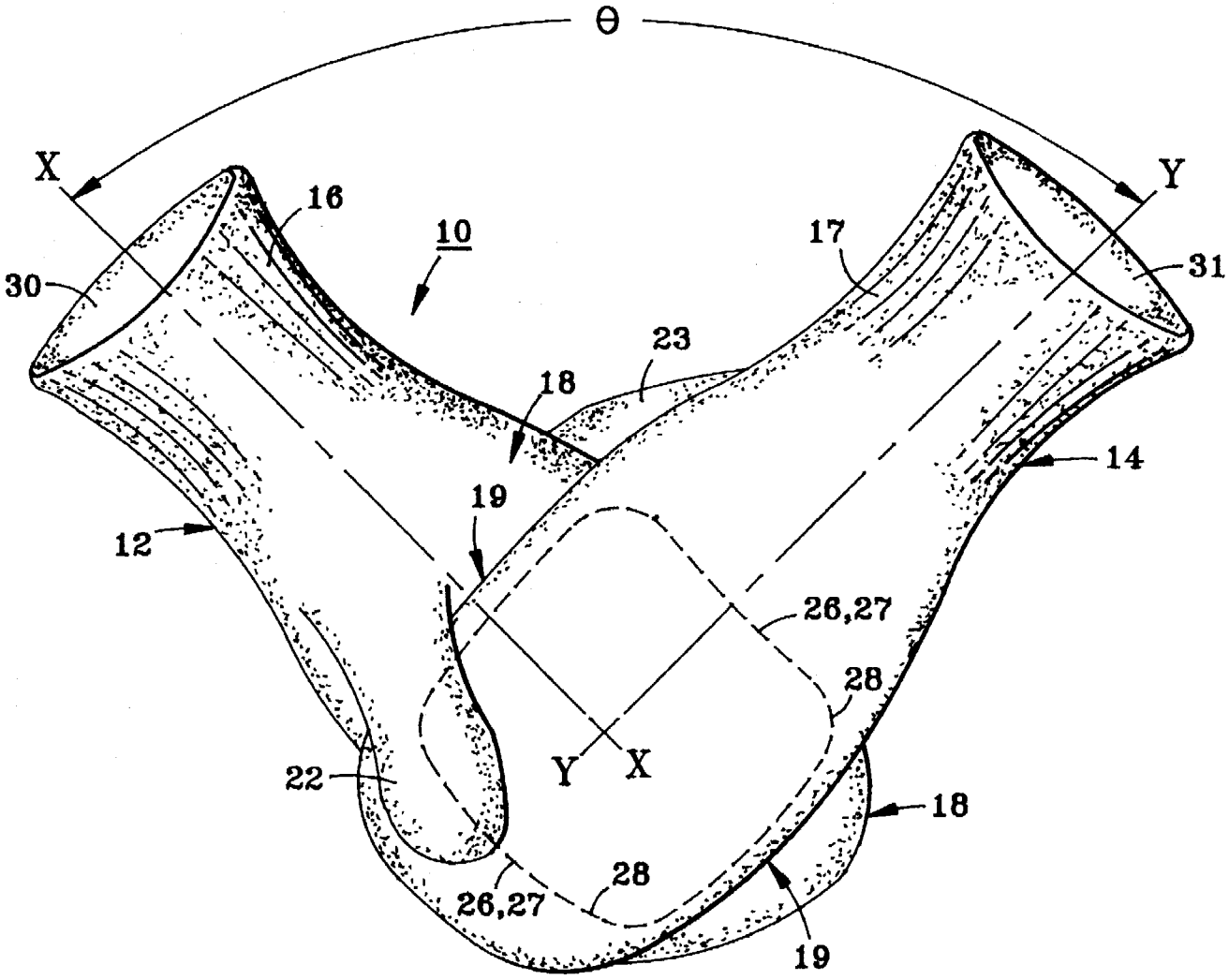
FIG. 3 is a perspective view of a receptacle formed by the joinder of the right-handed mitten of FIG. 1 and the left-handed mitten of FIG. 2, for receiving the left hand of a first person and the right hand of a second person in accordance with an embodiment of the invention herein.

Referring now to FIG. 3, there is shown for illustrative purposes only, a two-handed receptacle 10, constituting one embodiment of the invention, for the sharing of the right hand of one person and the left hand of a second person. The receptacle 10 is made up of a joined right-handed mitten 12 (FIG. 1) and left-handed mitten 14 (FIG. 2). The right-handed mitten 12 has a right wrist compartment 16 connected to a right hand compartment 18. The right hand compartment is comprised of a right palm-and-fingers section 20 that covers the back and front side of the palm and fingers of the hand, excluding the thumb. Attached to the right lateral side of the palm side of the right hand compartment is a right thumb section 22 which encloses the thumb. In like manner, the left-handed mitten 14 illustrated in FIG. 2 also comprises a left wrist compartment 17 and a left hand compartment 19, the latter being comprised of a left palm-and-fingers section 21 to which is attached a left thumb section 23 at the left lateral side of the palm side of the left hand compartment.

Each of mittens 12 and 14 is provided with an opening 24 and 25, respectively, on the palm side of the respective palm-and-fingers section 20 and 21 for substantially exposing the palm and fingers of the left and right hand, excluding the thumb. Both openings 24 and 25 are sized in such a way that when the palm sides of the respective hand compartments are contacted with each other, the openings will match one another to permit the right- and left-handed mittens to be secured to each other about the perimeters 26 and 27 of the respective openings 24 and 25. As illustrated in FIG. 3, the openings 24 and 25 are also sized in such a way that the longitudinal axis X—X of right wrist compartment 16 and the longitudinal axis Y—Y of left wrist compartment 17 of the joined right- and left-handed mittens form an angle θ which is approximately 90°. For purposes of offering an ergonomical positioning of the left and right-handed mittens relative to each other, it has been found that the angle θ should be less than 120°, and is preferably in the range of about 15° to about 120°. For maximum benefit, an angle of between about 45° and 100° has been found to be suitable for most couples sharing the two-handed receptacle.

The left- and right-handed mittens may be joined about the perimeters 26 and 27 of their respective openings in a fixed manner by any conventional means, for example by sewing, stitching, and the like. The mittens 12 and 14 illustrated in FIG. 3 are fixed to each other by stitching 28. As an alternative, the mittens may be joined in a removable manner by the provision of hook and loop fastener 29 (illustrated in FIG. 2), or by the provision of zippers, snaps, buttons or the like, about perimeters 26 and 27 of respective openings 24 and 25.

In use, when two persons desire to share the receptacle 10, the first person will insert his/her right hand through entrance 30 of the right-handed wrist compartment 16 and into right hand compartment 18, and the second person will insert his/her left hand through entrance 31 of the left-handed wrist compartment 17 into the left hand compartment 19. The right and left thumb sections 22 and 23 will automatically receive the respective right and left thumbs of the individuals, leaving the remainder of their hands to be contacted and shared with each other. As will be seen from FIG. 3, the provision of separate thumb sections 22 and 23 for each respective mitten 12 and 14 allows the thumb of the wearer to be folded over the back side of the palm-and-fingers section of the opposite mitten. In doing so, an ergonomical and secure fit is enhanced by the wearers of the two-handed receptacle.

Figure 4:
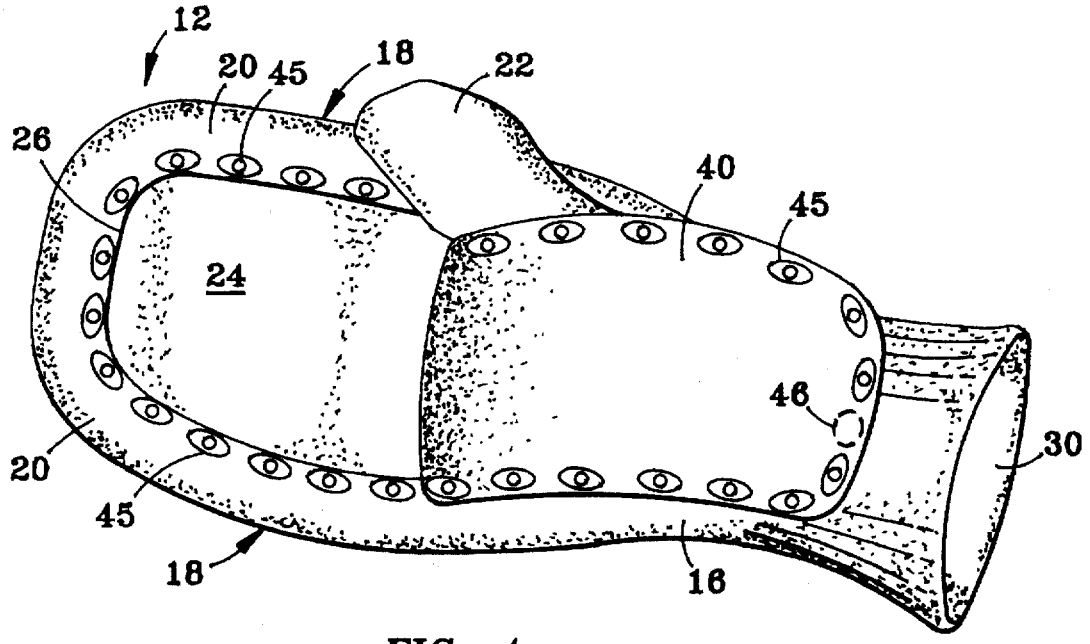
FIG. 4 is a perspective view of a right-handed mitten with a flap folded rearwardly and detachably secured to the wrist compartment for uncovering the opening in the palm-and-fingers section of the mitten in accordance with another embodiment of the invention herein.
Figure 5:
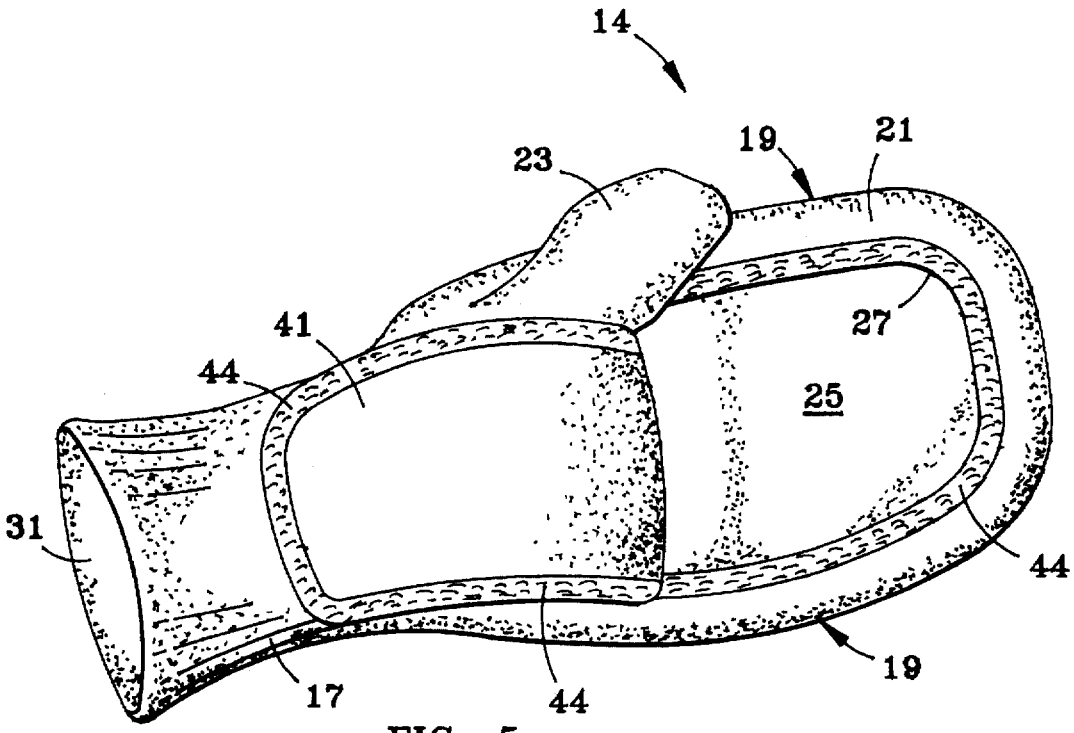
FIG. 5 is a perspective view of a left-handed mitten with a flap folded rearwardly to the wrist compartment for uncovering the opening in the palm-and-fingers section of the mitten in accordance with another embodiment of the invention herein.
Figure 5A:
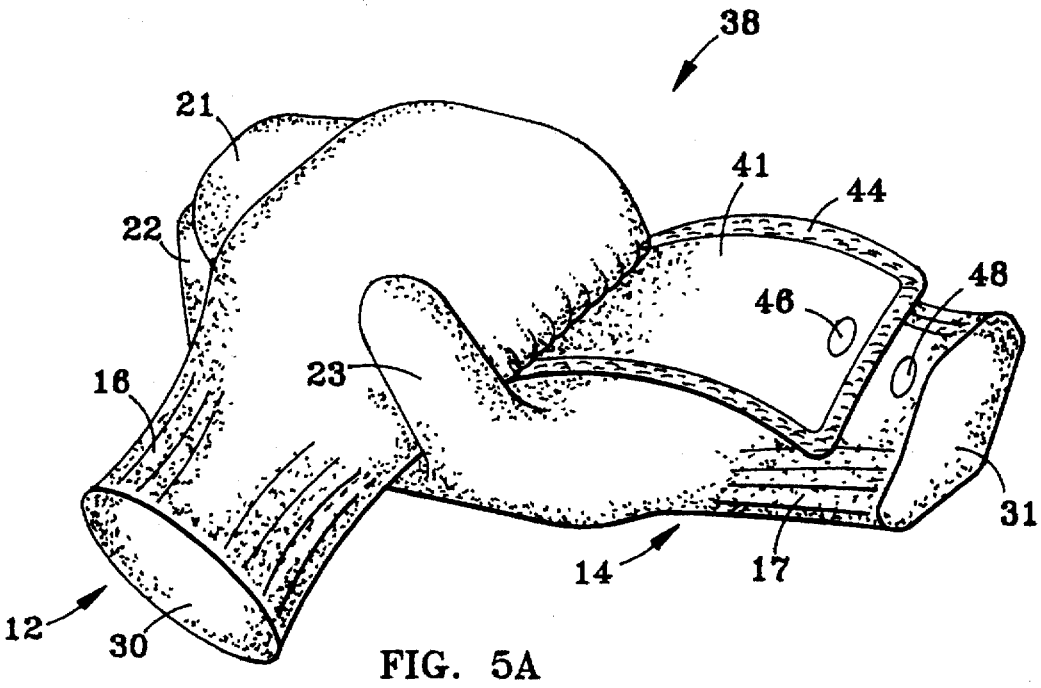
FIG. 5A is a perspective view of a receptacle formed by the joinder of the right-handed mitten of FIG. 4 and the left-handed mitten of FIG. 5 with the left hand flap folded back for detachable securement to its wrist compartment.

In accordance with another aspect of the invention, and as illustrated in FIGS. 4, 5 and 5A, the right- and left-handed mittens 12 and 14 are provided with removable flaps 40 and 41, respectively, which are configured for covering openings 24 and 25 in the palm-and-fingers sections 20 and 21. The purpose of the flaps is to provide a convertibility factor for the two-handed receptacle 38 (see FIG. 5A) so that when not in use it can be changed to a regular pair of mittens for use by a single person. The process can also be reversed when it is desired to convert the pair of mittens to a two-handed receptacle. This is done by uncovering the respective openings provided in the mittens by the removal of the appropriate flaps and connecting the mittens to each other, for example, in the manner illustrated in FIG. 5A.

As best illustrated in FIGS. 4 and 5, flaps 40 and 41 have the same physical configuration as openings 24 and 25, and are secured at and integral with the rearward portion of the respective palm-and-fingers sections 20 and 21. Flaps 40 and 41 are held in place over their respective openings by hook and loop fastener 44 secured about the perimeter of openings 24 and 25 (FIG. 5). When flaps 40 and 41 are folded back from their openings towards their respective wrist compartments 16 and 17, right- and left-handed mittens 12 and 14 can be fixed to each other about their openings 24 and 25 using fastener 44 in the manner shown in FIG. 5A. The use of hook and loop fastener 44, commonly available and sold under the registered trademark Velcro®, is preferred for joining the right-hand left-handed mittens to each, but other conventional fasteners known in the art can be utilized. They include, but are not limited to, zippers, snaps 45 (illustrated in FIG. 4), buttons 47 (illustrated in FIG. 8), and the like. It will be understood that the fasteners 44, 45 or 47 will only be deployed about three sides of openings 24 and 25 when one end of flaps 40 and 41 are integral with their respective palm-and-fingers sections 20 and 21.

Once the right- and left-handed mittens 12 and 14 are joined together to form the two-handed convertible receptacle 38, flaps 40 and 41 may be entirely removed from their respective mitten or, if fixed at one end with its respective palm-and-fingers section (as illustrated in FIGS. 4–8), may be detachably secured to receptacle 38 in any number of ways to prevent them from moving about. For example, as shown in FIG. 5A, left hand flap 41 is provided with a fastener 46 for detachably securing the forward portion of the flap to an area 48 located at the outside surface of the left wrist compartment 17. The same is true of right hand flap 40 which may also be detachably secured to the same general area of the outside surface of the corresponding right wrist compartment 16 (not shown in the drawing). It is also possible to use fastener 44, 45 or 47 in place of fastener 46 when, for example, fastener 46 is of the same type, e.g., a hook and loop fastener, at least one snap or at least one button.

Figure 6:
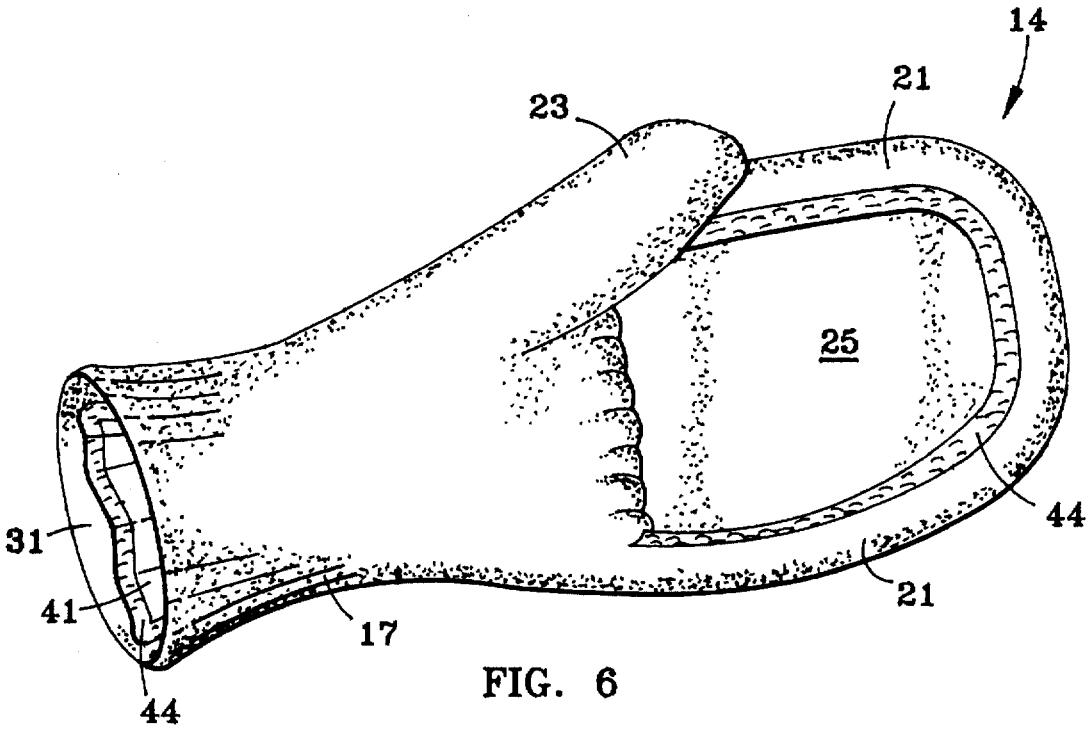
FIG. 6 is a perspective view of the left-handed mitten of FIG. 5 illustrating its flap being folded rearwardly through the mitten's opening and confined within the wrist compartment.

In the embodiment illustrated in FIG. 6, using left-handed mitten 14 as an example, flap 41 is first removed from its corresponding opening 25 and then tucked through the opening 25 and folded rearwardly into the confines of wrist compartment 17. Once the flap is secured within its respective wrist compartment, right- and left-handed mittens 12 and 14 can be secured to each other about their respective openings 24 and 25 with the use of hook and loop fastener 44. The same embodiment is applicable to right-handed mitten 12.

Figure 8:
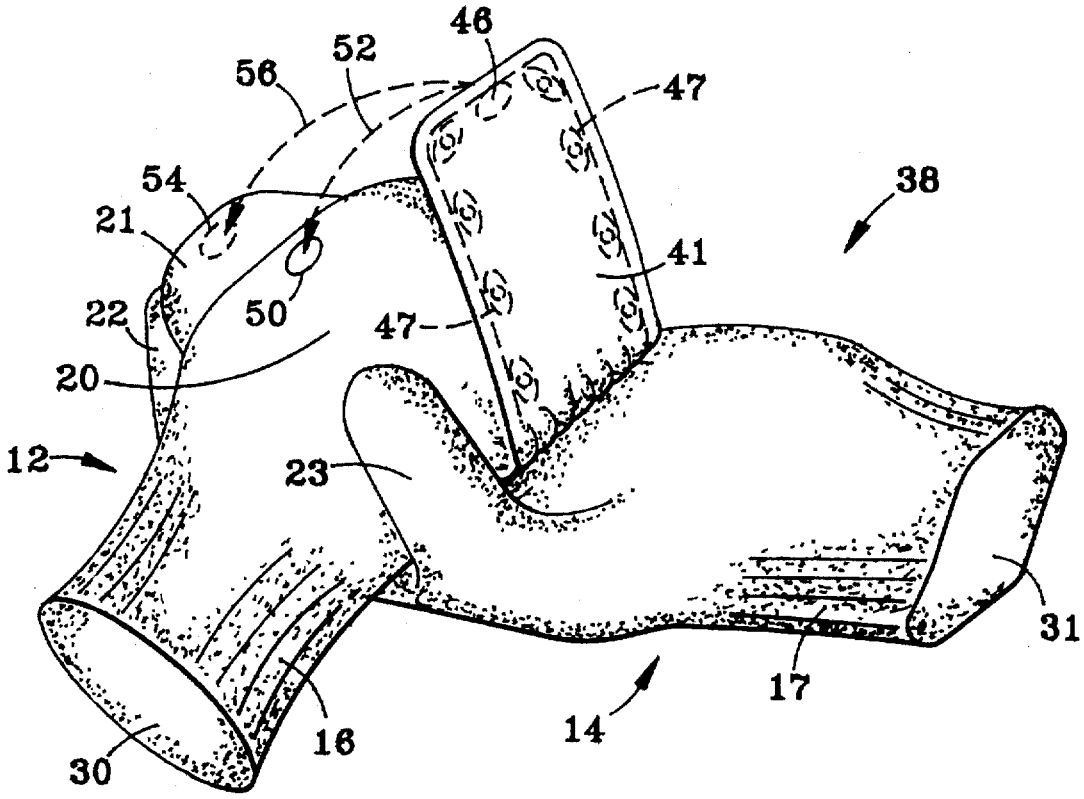
FIG. 8 is a perspective view of the receptacle of FIG. 5A illustrating the manner of detachably securing the flap of the left-handed mitten to the back side of the palm-and-fingers section of the right-handed mitten or to the forward portion of the left palm-and-fingers section after the right- and left-handed mittens are joined to each other.

Other embodiments are illustrated in FIG. 8 wherein flap 41 may be positioned over the back side of the right palm-and-fingers section 20 of the opposite mitten, in this case, right-handed mitten 12 (as shown by the direction of broken line 52), and secured to an area 50 thereof using the same fastener 46. Alternatively, as indicated by the direction of broken line 56, fastener 46 may be detachably secured to an area 54 on the forward portion of the left palm-and-fingers section 21. The latter embodiment has the effect of "locking in" the right hand mitten 12 by having flap 41 completely overlap the right palm-and-fingers section 20, thereby offering added securement for the formation of the two-handed convertible receptacle 38. It is to be understood that what has been said with regard to left hand flap 41 also applies to right hand flap 40 which may be positioned over the left palm-and-fingers section 21 of left-handed mitten 14 and detachably secured in the same manner described above.

Figure 7:
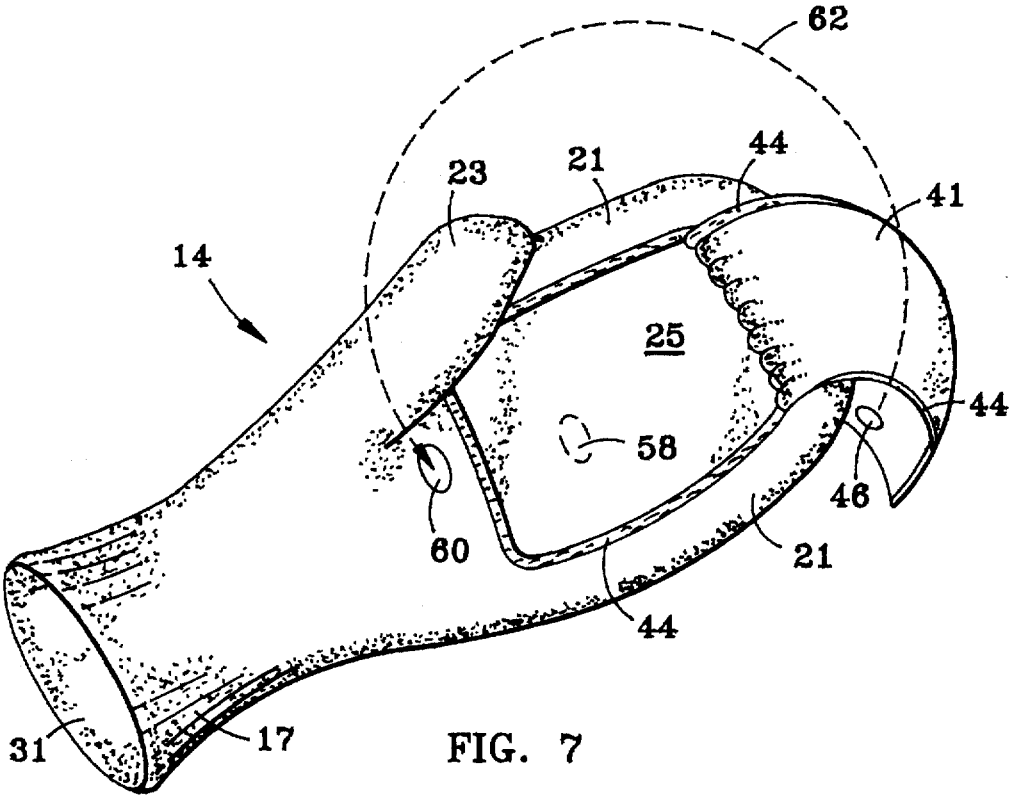
FIG. 7 is a perspective view of the left-handed mitten of FIG. 5 illustrating its flap being folded forwardly from the forward end of the palm-and-fingers section for detachable securement to the back side of the mitten's palm-and-fingers section.

FIG. 7 illustrates yet another embodiment for detachably securing flaps 40 and 41 to receptacle 38. As shown, the forward end of flap 41 (as well as flap 40) is fixed and integral with the forward portion of the palm side of the left palm-and-fingers section 21 of left-handed mitten 14. Once flap 41 is removed from its securement to left-handed mitten 14 via hook and loop fastener 44, it may be folded forwardly to expose opening 25 and detachably secured to an area 58 located on the back side of left palm-and-fingers section 21 using fastener 46. As an alternative, and after the right-handed mitten 12 is joined to left-handed mitten 14 about their respective openings 24 and 25, flap 41 may be folded over the right palm-and-fingers section 20 in the direction of broken line 62 and detachably secured to an area 60 located at approximately the rearward portion of the respective palm-and-fingers section 21 with the use of fastener 46. This arrangement has the effect of having flap 41 being positioned over and "locking in" the right palm-and-fingers section 20 of mitten 12 (not shown in Figure 7). Flap 40 of right-handed mitten 12 may also be fastened in a similar manner to "lock in" the left palm-and-fingers section 21 of left-handed mitten 14.

In each of the foregoing embodiments, fastener 46 may take the form of a hook and loop fastener, e.g., Velcro®, or at least one button or snap, or like means that are commonly known in the art, for detachably securing flaps 40 and 41 to the two-handed convertible receptacle 38. As already indicated, a portion of fastener 44 may also be used in place of fastener 46 for detachably securing the flaps in the various embodiments described above.

Figure 1:
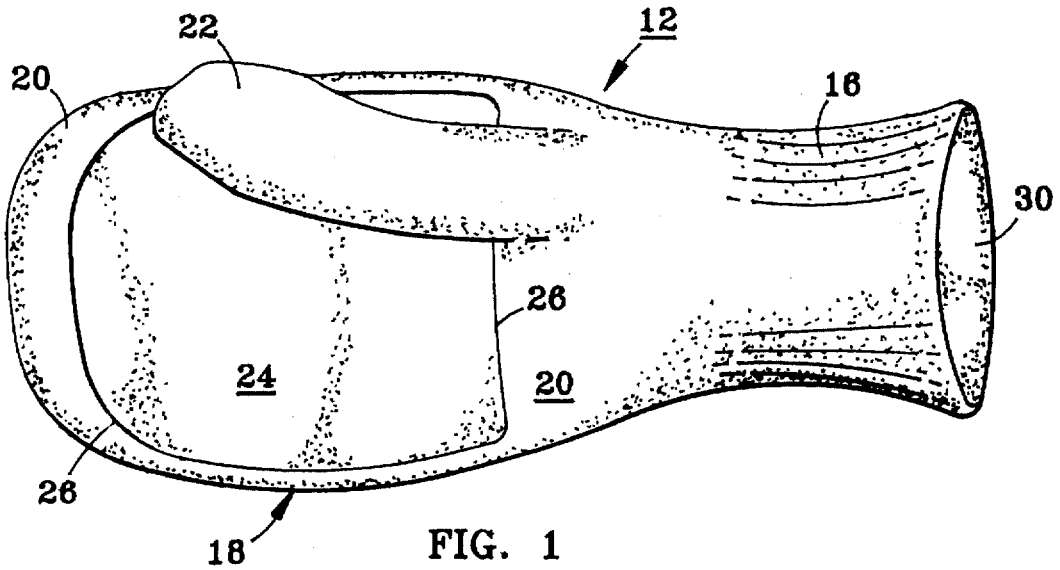
FIG. 1 is a top plan view of a right-handed mitten having an opening in the palm side of the palm-and-fingers section in accordance with the invention herein.

As with the two-handed receptacle 10 described hereinbefore and illustrated in FIGS. 1–3, convertible receptacle 38 and corresponding flaps 40 and 41 can be made or manufactured of any flexible material, either stretchable or non-stretchable, including, but not limited to, fabrics such as wool and cotton, synthetic materials, such as nylon and polyesters, and blends thereof, or leather, suede and any like materials, or combinations thereof, that are suitable for the protection of the hands. In the illustrations shown in FIGS. 4 through 8, the flaps and corresponding mittens are of the same construction, although for manufacturing and aesthetic purposes, they can be constructed of different materials.

The two-handed receptacle according to the various embodiments described above provides an inexpensive and ergonomical means for keeping the hands of two persons warm while at the same time enabling them to keep their hands in direct contact with each other. In addition, by providing a removable flap with each associated mitten, a conventional pair of mittens can be converted to a two-handed receptacle so that the left hand of one person and the right hand of another can be shared and made contact with within a protective environment.

Since other modifications and changes may be varied to fit the particular operating requirements and environments of the invention, which will be apparent to those skilled in the art, the invention is not considered to be limited to the embodiments chosen for purposes of disclosure, and covers all changes and modifications which do not constitute departures from the true spirit and scope thereof.

What is claimed is:

1. A receptacle for receiving the left hand of a first person and the right hand of a second person, comprising a) a left wrist and hand compartment connected to each other for enclosing the left wrist and hand, respectively, and a right wrist and hand compartment connected to each other for enclosing the right wrist and hand, respectively, each of said hand compartments comprising i) a palm-and-fingers section for enclosing the fingers and back and front side of the palm, excluding the thumb;

ii) a thumb section connected to the palm-and-fingers section for enclosing the thumb; and b) means for joining said left- and right-hand compartments about a perimeter of an opening provided in the front palm side of the palm-and-fingers section of each hand compartment, said perimeter defining an area generally covering the front of the palm and fingers of the hand, excluding the thumb, to form a common compartment that will permit contact of the left hand of the first person and the right hand of the second person, exclusive of their thumbs, interiorly thereof.

2. The receptacle according to claim 1 wherein the left and right wrist and hand compartments are in the form of a left- and right-handed mitten, respectively.

3. The receptacle according to claim 1 wherein a longitudinal axis of the respective wrist compartments connected to the joined left- and right-hand compartments form an angle less than 120 degrees with respect to each other.

4. The receptacle according to claim 1 wherein the joined left- and right-hand compartments form an angle in the range of from about 15 to about 120 degrees with respect to each other.

5. The receptacle according to claim 1 wherein said means for joining the left- and right-hand compartments comprises fixedly securing the compartments to each other by stitching.

6. The receptacle according to claim 1 wherein said means for joining the left- and right-hand compartments comprises means for detachably securing the compartments to each other.

7. The receptacle according to claim 6 wherein said means comprises a hook and loop fastener.

8. A receptacle for receiving the left hand of a first person and the right hand of a second person, comprising a) a left- and right-handed mitten, each comprising a wrist, thumb and hand compartment for enclosing the wrist and front and back portions of the hand; and b) means for joining said left- and right-handed mittens about the perimeter of an opening provided in the front palm side of the hand compartment of each mitten, said perimeter defining the area generally covering the palm and fingers of the hand, excluding the thumb, to permit contact of the left hand of the first person and the right hand of the second person within the joined mittens.

9. The receptacle according to claim 8 wherein a longitudinal axis of the wrist compartments of the joined left- and right-handed mittens form an angle less than 120 degrees with respect to each other.

10. The receptacle according to claim 8 wherein a longitudinal axis of the wrist compartments of the joined left- and right-handed mittens form an angle in the range of from about 15 to about 120 degrees with respect to each other.

11. The receptacle according to claim 8 wherein a longitudinal axis of the wrist compartments of the joined left- and right-handed mittens form an angle in the range of from about 45 to about 100 degrees with respect to each other.

12. The receptacle according to claim 8 wherein said means for joining the left- and right-hand compartments comprises fixedly securing the compartments to each other by stitching.

13. The receptacle according to claim 8 wherein said means for joining the left- and right-hand compartments comprises means for detachably securing said compartments to each other.

14. The receptacle according to claim 13 wherein said means for detachably securing said compartments to each other comprises a hook and loop fastener.

15. The receptacle according to claim 13 wherein said means for detachably securing said compartments to each other comprises a plurality of snaps.

16. The receptacle according to claim 13 wherein said means for detachably securing said compartments to each other comprises button means.

17. A receptacle for receiving the left hand of a first person and the right hand of a second person, comprising a) a left wrist and hand compartment connected to each other for enclosing the left wrist and hand, respectively, and a right wrist and hand compartment connected to each other for enclosing the right wrist and hand, respectively, each of said hand compartments comprising i) a palm-and-fingers section for enclosing the fingers and back and front side of the palm, excluding the thumb;

ii) a thumb section connected to the palm-and-fingers section for enclosing the thumb; and iii) means for covering an opening provided in the front palm side of the palm-and-fingers section of each hand compartment when said palm-and-fingers sections are not joined to each other, said opening having a perimeter defining an area generally covering the front of the palm and fingers of the hand, excluding the thumb; and b) means for removably joining the left and right hand compartments about the perimeter of the respective openings when said openings are uncovered by the respective means for covering the openings.

18. The receptacle according to claim 17 wherein said means for covering said opening comprises a removable flap.

19. The receptacle according to claim 18 wherein the rearward end of said flap, relative to the wrist compartment, is fixed at approximately the rearward portion of the respective palm-and-fingers section, the forward portion of said flap being detachably secured to the wrist compartment when the right and left hand compartments are joined together.

20. The receptacle according to claim 18 wherein the rearward end of said flap, relative to the wrist compartment, is fixed at approximately the rearward portion of its palm-and-fingers section, said flap being folded rearwardly and inserted within the confines of the wrist compartment.

21. The receptacle according to claim 18 wherein the flap of each hand compartment is positioned over the back side of the opposite palm-and-fingers section when the right and left hand compartments are joined together, the forward portion of each flap being detachably secured to either (i) the back side of the opposite palm-and-fingers section or (ii) the forward portion of the palm-and-fingers section of the respective hand compartment.

22. The receptacle according to claim 18 wherein the forward end of said flap, relative to the wrist compartment, is fixed with the forward portion of the palm side of the palm-and-fingers section, the rearward portion of each flap being detachably secured to the back side of the palm-and-fingers section of the respective hand compartment when the right and left hand compartments are joined together.

23. The receptacle according to claim 22 wherein the flap of each hand compartment is positioned over the back side of the opposite palm-and-fingers section when the right and left hand compartments are joined together, the rearward portion of each flap being detachably secured to either (i) the back side of the opposite palm-and-fingers section or (ii) the rearward portion of the palm-and-fingers section of the respective hand compartment.

24. The receptacle according to claim 16 wherein the flap and receptacle are constructed of the same material.

25. A pair of mittens capable of being converted to a receptacle for receiving the left hand of a first person and the right hand of a second person, comprising a) a left- and right-handed mitten, each comprising a wrist and hand compartment connected to each other for enclosing the wrist and hand, respectively, said hand compartment comprising i) a palm-and-fingers section for enclosing the fingers and back and front side of the palm, excluding the thumb;

ii) a thumb section connected to the palm-and-fingers section for enclosing the thumb; and iii) a removable flap for covering an opening provided in the front palm side of the palm-and-fingers section of each mitten when said palm-and-fingers sections are not joined to each other, said opening having a perimeter defining an area generally covering the front of the palm and fingers of the hand, excluding the thumb; and b) means for removably joining the left- and right-handed mittens about the perimeter of the respective openings when said openings are uncovered by the respective flaps.

26. The mittens according to claim 25 wherein the rearward end of said flap, relative to the wrist compartment, is fixed with the palm side of the palm-and-fingers section at approximately the rearward portion thereof, said flap being configured to fold rearwardly to permit exposure of said opening in the palm-and-fingers section.

27. The mittens according to claim 26 wherein the rearward end of said flap is integral with the palm-and-fingers section of the mitten.

28. The mittens according to claim 26 additionally comprising means for detachably securing each flap to (i) its respective wrist compartment, (ii) the forward portion of its respective palm-and-fingers section, or (iii) the back side of the opposite palm-and-fingers section.

29. The mittens according to claim 28 wherein said means comprises a hook and loop fastener.

30. The mittens according to claim 28 wherein said means comprises at least one button means.

31. The mittens according to claim 28 wherein said means comprises at least one snap.

32. The mittens according to claim 26 wherein the flap is configured to be folded rearwardly through the opening for insertion within the confines of the wrist compartment.

33. The mittens according to claim 25 wherein the forward end of said flap, relative to the wrist compartment, is fixed with the forward portion of the palm side of the palm-and-fingers section, said flap being configured to fold forwardly to permit exposure of said opening in the palm-and-fingers section.

34. The mittens according to claim 33 wherein the forward end of said flap is integral with the palm-and-fingers section of the mitten.

35. The mittens according to claim 33 additionally comprising means for detachably securing each flap to (i) the back side of its respective palm-and-fingers section, (ii) the rearward portion of its respective palm-and-fingers section, or (iii) the back side of the opposite palm-and-fingers section.

36. The mittens according to claim 35 wherein said means comprises a hook and loop fastener.

37. The mittens according to claim 35 wherein said means comprises at least one button means.

38. The mittens according to claim 35 wherein said means comprises at least one snap.

39. The mittens according to claim 25 wherein the flap and mitten are constructed of the same material.

* * * * *